US006264255B1

(12) United States Patent
Fortune

(10) Patent No.: US 6,264,255 B1
(45) Date of Patent: Jul. 24, 2001

(54) LATCH DRIVE ASSEMBLY

(76) Inventor: Geoffrey J. Fortune, 10 Luckie Street, Nunawading, Victoria, 3131 (AU)

( * ) Notice: Subject to any disclaimer, the term of this patent is extended or adjusted under 35 U.S.C. 154(b) by 0 days.

(21) Appl. No.: 09/171,220

(22) PCT Filed: May 29, 1997

(86) PCT No.: PCT/AU97/00338

§ 371 Date: Dec. 16, 1998

§ 102(e) Date: Dec. 16, 1998

(87) PCT Pub. No.: WO97/45613

PCT Pub. Date: Dec. 4, 1997

(30) Foreign Application Priority Data

| | | |
|---|---|---|
| May 29, 1996 | (AU) | P00130 |
| Nov. 11, 1996 | (AU) | P03526 |
| Apr. 11, 1997 | (AU) | P06133 |

(51) Int. Cl.[7] ..... E05B 3/00

(52) U.S. Cl. ..... 292/336.3; 292/348; 292/DIG. 53

(58) Field of Search ..... 292/336.3, 347, 292/348, 349, 352, 353, 355, 356, 357, DIG. 53, DIG. 62

(56) References Cited

U.S. PATENT DOCUMENTS

| | | | | |
|---|---|---|---|---|
| 45,836 | * | 1/1865 | Kennedy | 292/347 |
| 538,952 | * | 5/1895 | Donovan | 292/347 |
| 1,495,820 | * | 5/1924 | Tierney | 292/DIG. 62 |
| 1,519,500 | * | 12/1924 | Miller | 292/356 |
| 1,519,503 | * | 12/1924 | Norwood | 292/356 |
| 2,190,951 | * | 2/1940 | Roach | 292/348 |
| 2,400,403 | * | 5/1946 | Falk | 292/359 |
| 5,029,914 | * | 7/1991 | Hankel | 292/DIG. 62 |
| 5,161,837 | * | 11/1992 | O'Brien | 292/DIG. 62 |
| 5,316,355 | * | 5/1994 | Hartwell | 292/347 |

* cited by examiner

*Primary Examiner*—Gary Estremsky

(57) ABSTRACT

An assembly comprising a pair of latch drive mechanisms each being mountable on opposite sides of a door and including drive members to actuate a door latch mechanism mounted within the door. The assembly further includes a pair of handles, each of which is rigidly fixed to the surface of an escutcheon component which attaches to the latch actuating member of the latch drive mechanism and, when so attached, conceals the latch drive mechanism. Also included is a privacy locking set adapted for use with the latch drive assembly which provides a control function at the inside of the door which locks the handle at the outside of the door. The control side also includes an automatic release function actuated by the operation of the handle at the control side. The release function incurs no lost motion due to an independent handle operation feature of the latch drive mechanism.

5 Claims, 10 Drawing Sheets b a

LATCH DRIVE ASSEMBLY

FIELD OF THE INVENTION

This invention relates generally to door handles and the associated latch operating mechanisms and is concerned in particular with providing a mechanism which facilitates greater scope for the aesthetic design of door handles. Also included as part of this invention is a "privacy" handle locking mechanism which can be installed with the latch drive assembly where a privacy locking function is required. The doors referred to herein being access doors to buildings and rooms within buildings.

BACKGROUND ART

Most hinged doors in any building are equipped with door handles. The handles facilitate the manual operation of the latching mechanism and the manual opening and closing of the door. A door handle requires some componentry to facilitate these two functions and typically comprise the following; The handle itself, being a knob or lever with a projecting stem rotatably attached to a mounting plate, generally defined as an escutcheon. The escutcheon provides a bearing for the stem and for attachment to the door, and means provided within the handle stem for rotational actuation of the latch mechanism, usually via mutual engagement with a square section shaft.

The handle and the escutcheon, being visible components, are generally required to have a good appearance and traditionally have been designed, ornamented and finished to maximise their esthetic appeal. Various methods have been devised to improve their appearance by concealing the fixing screws, commonly used to attach the escutcheon to the door. This is generally achieved by providing a mounting plate, which employs the normal screw attachment to the door, and some concealed coupling arrangement which provides for the attachment of the escutcheon to the mounting plate. Examples of this are disclosed in Australian patent 653083 in which a threaded central boss within the escutcheon engages within a central thread of the mounting plate, and the lug and groove twist action of Australian patent 14803/95.

Lever handles are preferable to knobs from a functional point of view, and are the normal form of door handle in most commercial or public premises. Knobs cannot be operated by any means other than hand rotation, and are thus more difficult to operate for persons with some types of disability of the hand. Lever handles are less reliant on the strength of grip and can be easily operated by downward pressure of a hand or even an elbow. However, lever handles are not without disadvantages. A spring is generally required within the mechanism to return the lever after operation to its "at rest" position and to prevent lever droop. Also, the requirement for the lever to be fixed at one end to a stem has meant that the range of lever handle shapes, though often embodying good design, has been quite limited.

Prior art also acknowledges the requirement to include a "privacy" locking function as an option within a door handle product range. This facility is generally required in toilets and bathrooms where the occupant is able to engage the locking function to prevent the accidental intrusion of other persons. Typical examples of this facility are disclosed in U.S. Pat. No. 5,505,508 and Australian patent 653083 wherein the locking function is provided as a separate accessory which is adapted to be installed together with the handle assembly. These patents also, coincidentally, include an example of a concealed handle mounting arrangement mentioned above.

SUMMARY OF THE INVENTION

It is an object of this invention to at least in part overcome the above-mentioned limitation on the range of possible designs of lever handles and also to incorporate a concealed mounting arrangement.

To achieve this objective, the invention provides an arrangement which allows different methods and locations for the attachment of lever handles, thus avoiding the prior insistence on the attachment of lever handles to a stem at the axis of rotation.

The invention provides, in a first aspect, a latch drive assembly comprising:

- a pair of latch drive mechanisms each being mountable on opposite sides of a door and including means to engage with and rotationally actuate a conventional door latch mechanism mounted within the door via engagement with a drive shaft;
- each latch drive mechanism comprising a mounting plate member with means for mounting to an outer surface of a door and including concentric bearing means for rotationally locating a drive member;
- the drive member comprising a substantially circular plate and includes a cylindrical boss component projecting from the center of one face, the boss being rotatably engaged within the central bore of the mounting plate member and the face of the circular plate overlying and in parallel contact with the outer face of the mounting plate,
- the boss component further includes a concentric passage shaped to engage with and transmit rotational action to the drive shaft,
- the latch drive mechanism preferably includes a spring means acting between the mounting plate member and the drive member for returning the drive member to the rotational stop position after actuation;
- the latch drive assembly further includes a pair of handle units, each comprising a manually graspable lever element joined to a preferably circular escutcheon; and
- means within the escutcheon to attach the handle unit to the drive member by engagement with complementary means provided at the periphery of the drive member such that rotation of the handle is transmitted to the drive mechanism via its attachment to the escutcheon, the escutcheon, when so attached, substantially enveloping and concealing the latch drive mechanism;
- the drive member further includes disengagable latch means for irrotationally retaining the escutcheon;

The shaped passage within the boss section of the drive member can be of a partially circular cross section which permits a limited degree of free rotation within the drive shaft engagement, the orientation of these passages in the two opposing latch drive units arranged to provide the transmission of rotational drive to the latch unit by the actuation of either handle whilst allowing the opposite latch drive unit to remain stationary.

It has been recognised that the market requires that any product range of door handle fittings must include a privacy locking function for bathroom, toilet, and bedroom applications. To this end the invention preferably includes a novel privacy locking arrangement and, in a second aspect, provides a latch drive set including this feature. More specifically, the invention according to the first aspect preferably includes privacy locking means, which includes;

- a control unit for mounting at one side of a door and having finger operable setting means;

a lock unit for mounting at the other side of the door selectively settable at a lock condition in which the handle unit at that side of the door is locked against rotation;

means for linking the control unit to the lock unit whereby finger operation of the setting means is effective to set the lock unit in its lock condition; and means in the control unit whereby rotation of the handle at the one side of the door actuates the setting means and in turn, by virtue of the linking means, disengages the lock condition, during the independent operative rotation of the handle at one side of the door relative to the handle at the other side of the door, In its second aspect, the invention provides for use in conjunction with a door latch set including a latch unit, drive shaft means, a pair of handle units adapted to be mounted at opposite sides of a door panel, and means for drivingly coupling the handle units to the shaft means so that the respective handle means independently rotate the shaft means without rotation of the other handle unit, a privacy locking set including;

a control unit for mounting at one side of the door and having finger operable setting means;

a lock unit for mounting at the other side of the door selectively settable at a lock condition in which the handle unit at that side of the door is locked against rotation;

means for linking the control unit to the lock unit whereby finger operation of the setting means is effective to set the lock unit in its lock condition; and means in the control unit whereby rotation of the handle at the one side of the door releases the setting means and in turn, by virtue of the linking means, the lock condition, during the independent operative rotation of the handle at the one side of the door relative to the handle at the other side of the door.

BRIEF DESCRIPTION OF THE DRAWINGS

The invention will now be further described, by way of example only, with reference to the accompanying drawings, in which.

DESCRIPTION OF PREFERRED EMBODIMENT

Basic Set

Figure 1:
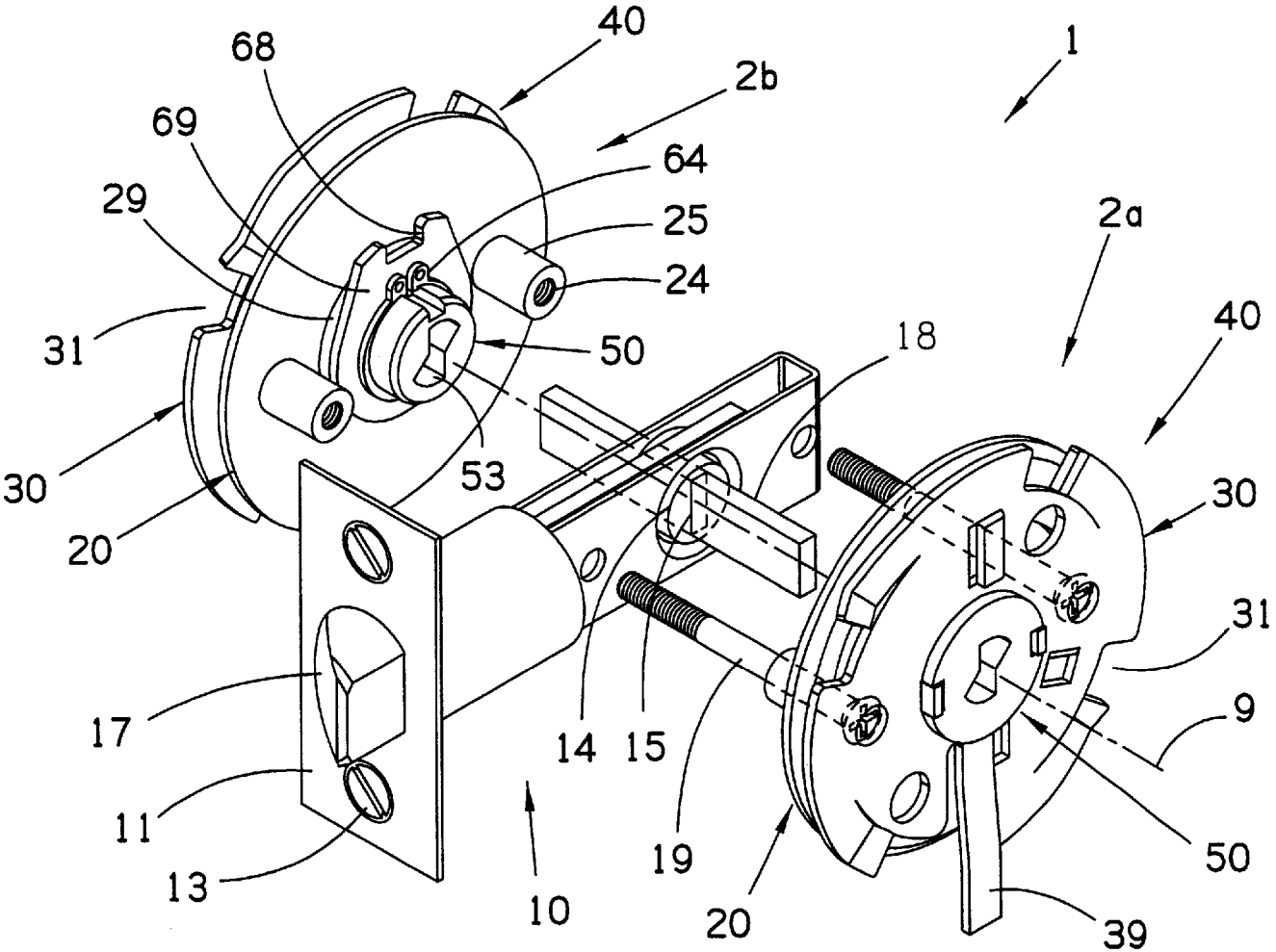
FIG. 1 is an exploded three dimensional view of the principal components of a basic door latch set incorporating a pair of latch drive assemblies formed from latch drive sets according to a first embodiment of the first aspect of the invention.

In FIG. 1, the illustrated door latch set 1 includes a latch unit 10 of conventional construction, a pair of similar latch drive assemblies 2*a* and 2*b* which are each formed from an individual latch drive set, and a latch drive shaft 18 of uniform rectangular cross section.

The two latch drive assemblies 2*a* and 2*b* are basically identical save for being a mirror image of each other and being of opposite rotation. Their main difference lies in their provision for the screws 19, one assembly having countersunk clearance holes 23 provided in the mounting plate 20, the other equipped with corresponding threaded holes 24 in bosses 25 of the opposing mounting plate. It is therefore proposed to described only one of the assemblies and to identify the differences where appropriate.

Each latch drive assembly 2*a*,2*b* includes a mounting plate 20, a drive member 40 comprising an annular drive plate 30 about a boss 50, and a handle unit 70.

Figure 2:
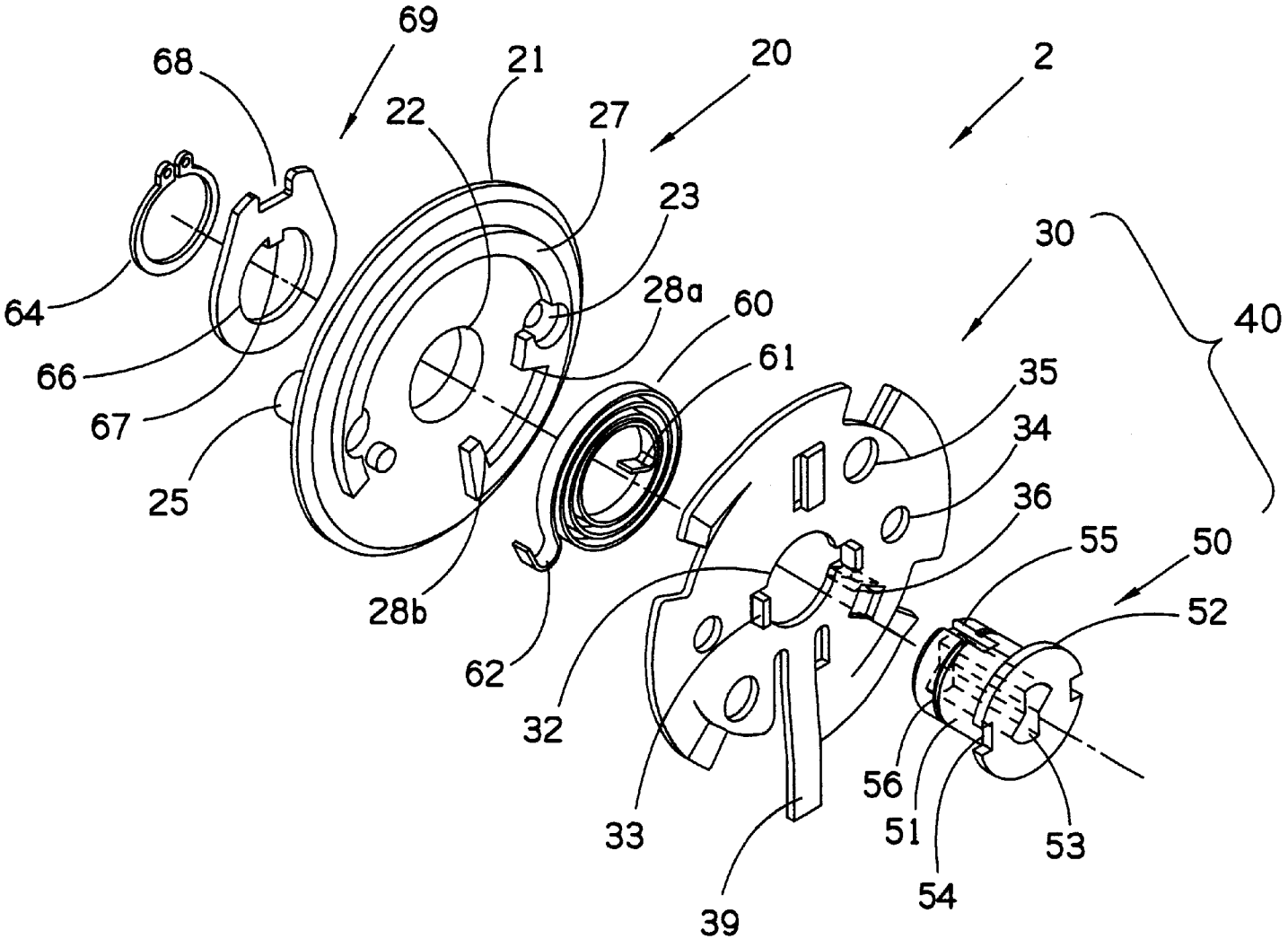
FIG. 2 is an exploded view showing the components of one of the latch drive assemblies.

The mounting plate 20 (FIG. 2) is essentially a disc for covering the cross passage in the door panel and rotatably mounting the drive member 40. It may be produced as a metal die casting, a metal pressing or as a plastic molding. Plate 20 comprises a flanged surface 21 which provides a clamping interface with the door panel, and has a circular central aperture 22 at its center which serves as a bearing to accommodate a cylindrical body section 51 of drive boss 50. An integral central boss 29 projects on the reverse side (i.e. inside) of mounting plate 20 (FIG. 1), its purpose being to laterally position a cam washer 69 (discussed further later) for its required function relating to the optional privacy locking assembly 100 (FIGS. 8 to 10) when this is provided. The raised arcuate land or annulus 27 provides a bearing surface at its interface with the drive plate 30. It also defines and bounds a space to accommodate a spiral leaf return spring 60.

Two arcuately spaced facing shoulders 28*a*, 28*b* project from the inner side of the raised land or annulus 27. Shoulders 28*a*, 28*b* interact with a projecting tag 36 of the drive plate 30 to define limits to the relative rotation of drive member 40 with respect to mounting plate 20 about axis 9. Shoulder 28*a* determines the return stop or 'at rest' position of the spring return rotational travel of the drive plate 30.

The drive plate 30 is ideally produced from spring steel and forms a sub-assembly with the drive boss 50 and the return spring 60. The cylindrical body section 51 of drive boss 50 forms a close fit with a central aperture 32 of the drive plate and rotational drive is transmitted via the engagement between integral key tags 33 of the drive plate adjacent aperture 32, and respective slots 54 in a flanged head 52 of the drive boss. The return spring 60 is assembled on the reverse side of the drive plate 30, between the drive plate and mounting plate and within land 27. The spring is concentric with the drive boss 50, with an end inner tag 61 of the spring engaging in a slot or hole (not shown) provided in the cylindrical section 51 of the drive boss. The outer hooked end 62 of spring 60 locates about an anchor spigot 26 projecting from the mounting plate 20 adjacent one end of land 27.

This sub assembly locates with the mounting plate 20. The cylindrical section 51 of the drive boss 50 rotatably engages within the central aperture 22 of the mounting plate. With the end hook 62 of the return spring 60 engaged about spigot 26 of the mounting plate, the sub-assembly is rotated in the appropriate direction to pre-tension the return spring to ensure the engagement of the stop tag 36 of the drive plate with the rotational stop 28*a* of the mounting plate.

As already noted, the back or inside face of the drive plate locates against the raised land or annulus 27 of the mounting plate. The cylindrical body 51 of the drive boss projects beyond the end face of the rear boss 29 of the mounting plate. Thus, the drive member 40 overlies the mounting plate 20. A central aperture 66 of the cam washer 69 engages with the projecting section of the drive boss, the two being rotationally keyed by engagement of an inner key tab 67 on the cam washer with a longitudinal keyway 55 of the drive boss. The inner face of the cam washer 69 locates against the end face of the rear boss 29, and a circlip 64 engages in a circular groove 56 of the drive boss to maintain the assembly of the drive member 40 with the mounting plate 20. The axial location of the circular groove 56 relative to the flanged drive boss head 52 is set to provide close contact between the assembled components when the circlip is engaged within the groove. The closeness of the contact between these components must allow freedom for rotational movement about axis 9 (within the limits set by the stops 28*a*, 28*b*) while allowing only minimal lateral movement in the axial direction.

Figure 3:
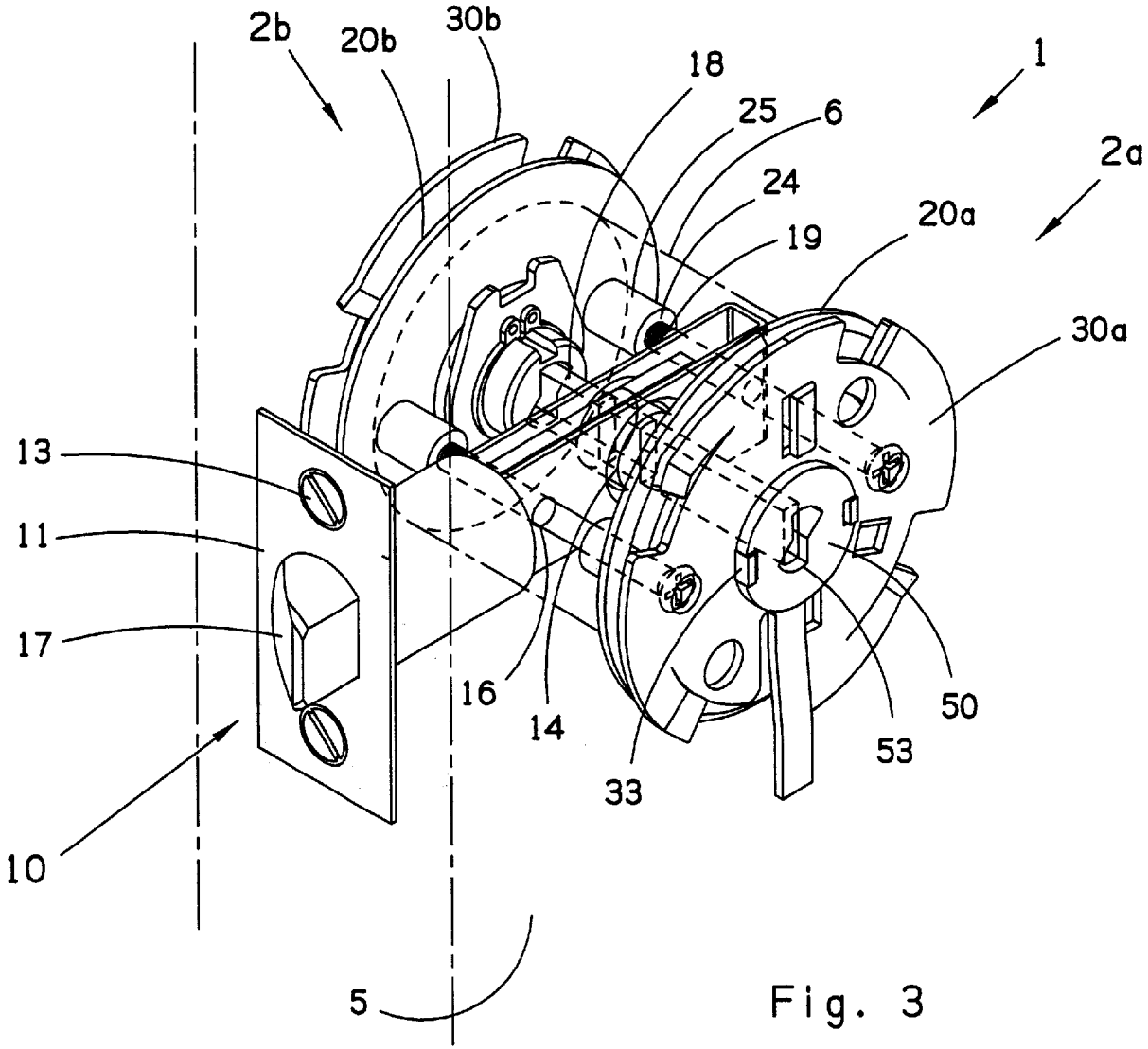
FIG. 3 depicts the door latch set installed in a door.

In FIG. 3 the latch set is shown mounted on a door panel 5 overlying and concentric with a transverse hole 6 which represents the trade standard 54 mm diameter hole. A standard 22 mm bore (not shown) accommodates latch unit 10.

Latch unit 10 includes a faceplate 11 with apertures 12 by which screws 13 are employed to fasten the faceplate in a rebate at the edge of the door panel, thereby securing the latch unit in the door. The latch drive assemblies 2*a* and 2*b* are fitted, one on either side of the door at opposite ends of the transverse passage 6. They are coupled by the rectangular shaft 18 which passes through the passage 15 (FIG. 1) of the latch unit 10 and engages at either end within shaped passages 53 of drive bosses 50 located within the keyed apertures 32 of the rotatable drive plates 30*a* and 30*b*.

The latch drive assemblies 2*a*, 2*b* are fastened together by a pair of fixing screws 19 which pass through the countersunk holes 23 (FIG. 2) in one assembly, and through holes 16 in the latch unit 10, and engage in threaded holes 24 (FIG. 1) of the other drive assembly. The screws draw the respective drive assembly mounting plates 20 together, clamping them firmly against the surfaces of the door panel about the open ends of the transverse passage 6. Either drive plate 30 transmits rotational movement to its respective drive boss 50 by means of the key tags 33, engaged in the slots 54 of the drive boss 50. Rotational movement is further transmitted to the rotatable sleeve 14 of the latch unit 10 via the rectangular shaft 18. Shaft 18 engages both the shaped passage 53 of each drive boss 50 and the rectangular passage 15 in the latch unit and, by virtue of a retractor mechanism (not shown) within the latch unit 10, rotation of shaft 18 is effective to retract latch bolt 17 behind facing plate 11 against an internal spring (not shown) biased to return the latch bolt outwardly. (the rectangular shaft requiring a 3.7 mm square section at its center to engage with most standard latches)

By virtue of the shaped passages 53 of the two opposing drive bosses 50, the rotation of either latch drive assembly will transmit sufficient rotation to shaft 18 and to the latch unit to retract the latch bolt 17, without causing the other latch drive assembly to rotate. This feature of independent rotation of the latch drive assemblies is required for the functioning of the privacy locking assembly, discussed further below.

Figure 4:
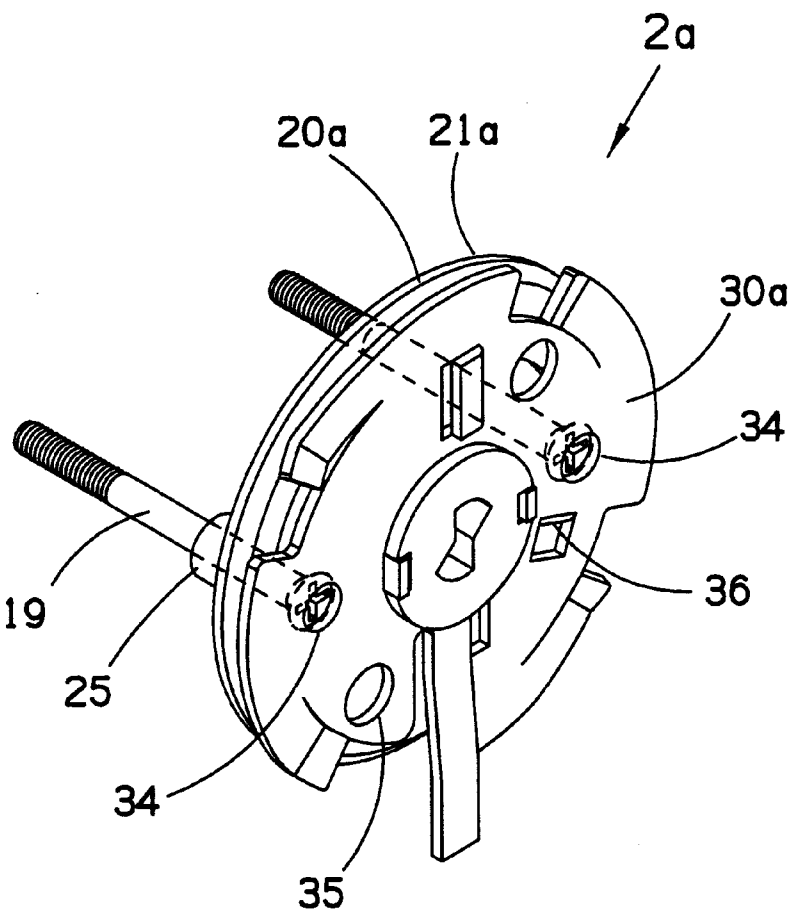
FIG. 4 shows the installation of the fixing screws into one of the latch drive assemblies.
Figure 4:
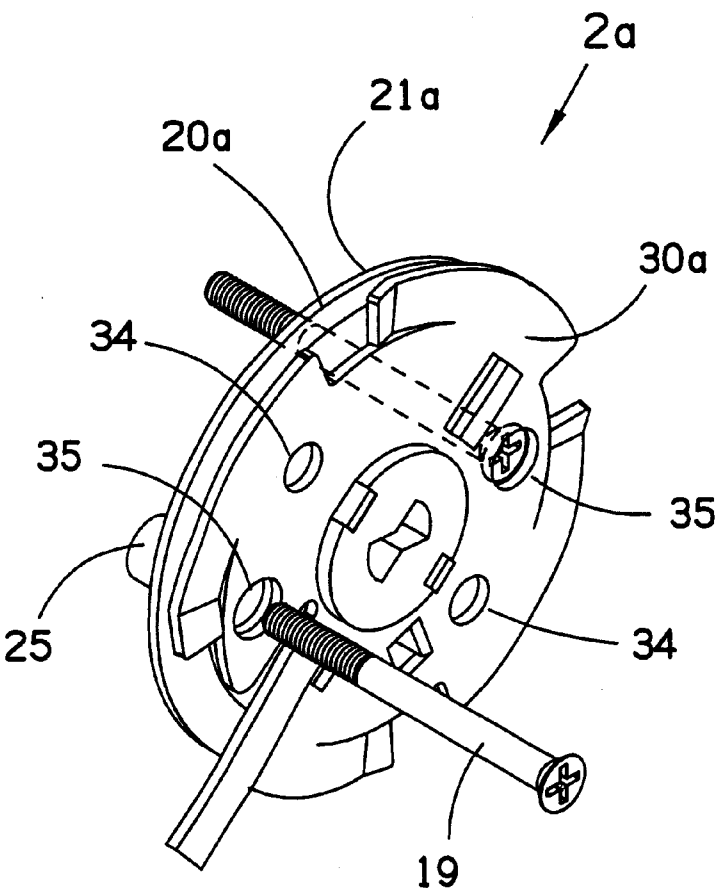

FIG. 4 shows the proposed method of installing the two screws 19 into the latch drive assembly. The reasons for this slightly complex procedure are as follows. It is necessary, when installing the latch drive assemblies, to gain access to the heads of the fixing screws by means of a screwdriver in order to engage them with the corresponding threaded bosses of the other assembly. This access may be facilitated by means of appropriately located holes through the drive plate 30. However, if these holes are large enough to facilitate the installation of the screws through the drive plate there would then exist a possible safety hazard for this product in service. In the event of either of these screws 19 becoming loose, it would be possible for the screw head to engage within the hole provided in the drive plate and thus render the door locked. By the alternative provision of the smaller holes, large enough to provide access for a suitable screwdriver but too small to accommodate the screw head, this problem is prevented.

The solution to the above problem however generates another in the installing of the screws into the latch drive assembly. The screws could be pre-assembled into the appropriate latch drive assembly but the length of the screws installed could not accommodate any variation of door thickness greater than 8 mm. For this reason the person installing the product must be able to select and install the appropriate length of screw for the particular door being fitted.

To facilitate the above requirements, the following principals have been devised. In the left diagram a of FIG. 4, the drive plate 30 is shown rotated against the return spring force to the second stop position defined by shoulder 28*b*. At this point two larger holes 35 in the drive plate align with the countersunk screw holes 23 of the mounting plate. These holes 35 are large enough to allow passage of the heads of the screws 19. The screws are therefore inserted through holes 35 into the screw clearance holes 23 of the mounting plate, the heads passing through the clearance holes 35 of the drive plate to engage with the countersinks of holes 23 provided in the mounting plate. The drive plate 30 is then released, allowing it to rotate under spring pressure to return to the stop position defined by shoulder 28*a* (right diagram b of FIG. 4). At this position two smaller holes 34 in the drive plate align with the screw heads allowing screwdriver access.

Figure 5:
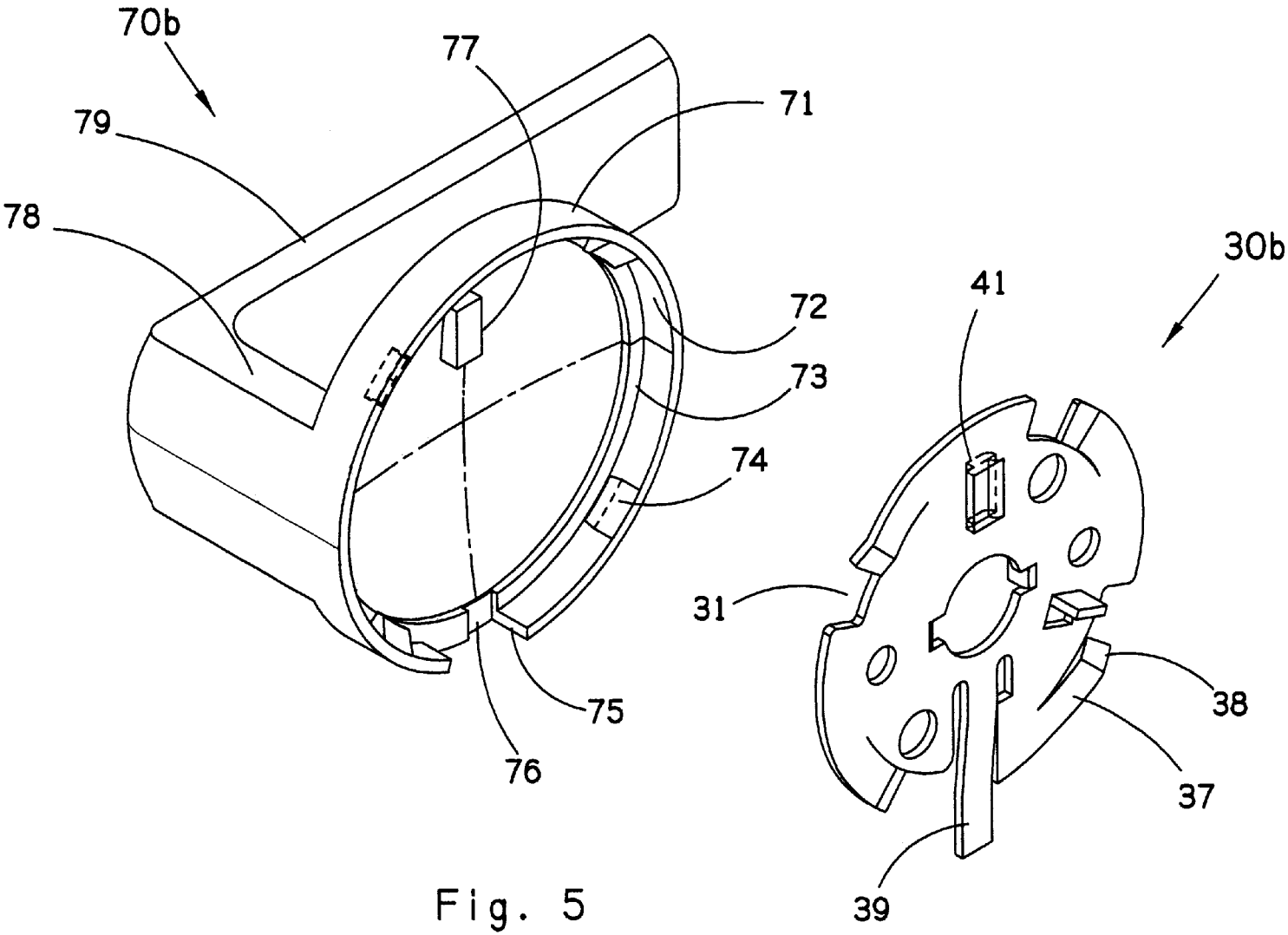
FIG. 5, depicts the details of a coupling system for mounting a handle unit to the drive plate of the latch drive assembly.

FIG. 5 shows handle unit 70 with lever handle 79 fixed at one end to escutcheon 71 by a joining member 78. The escutcheon is designed to be detachably mounted to drive plate 30 by the engagement of coupling arrangements within the escutcheon and at the perimeter of the drive plate. The normally circular escutcheon is recessed, defining a cylindrical wall 72 and an adjacent annular mounting surface 73. Four integral undercut lugs 74 are positioned around the inner wall 72. There is an opening 75 in the inner wall located non-symmetrically about the vertical centerline of the circular and a recess 76 in the mounting surface 73 is located symmetrically about the vertical centerline. A projecting lug 77 located in the upper half of the escutcheon recess provides an abutment to transmit the rotational drive force from the handle to an opposed projection 41 of the drive member 30.

Four crescent shaped or arcuate resiliently deflectable tag members 37, equispaced around and concentric with the rim of the drive plate 30, are inclined slightly away from the surface plane of the drive plate. A short section 38 at the free end of each crescent member is angled back towards the surface plane of the drive plate. Four notches 31 are provided beyond the end of each crescent member. A resiliently deflectable pawl is formed by a strip 39 extending radially downwards from near the central aperture of the drive plate. This strip is similarly inclined from the surface plane of the drive plate but opposite to that of the four crescent shaped arcuate tag members 37.

Figure 6:
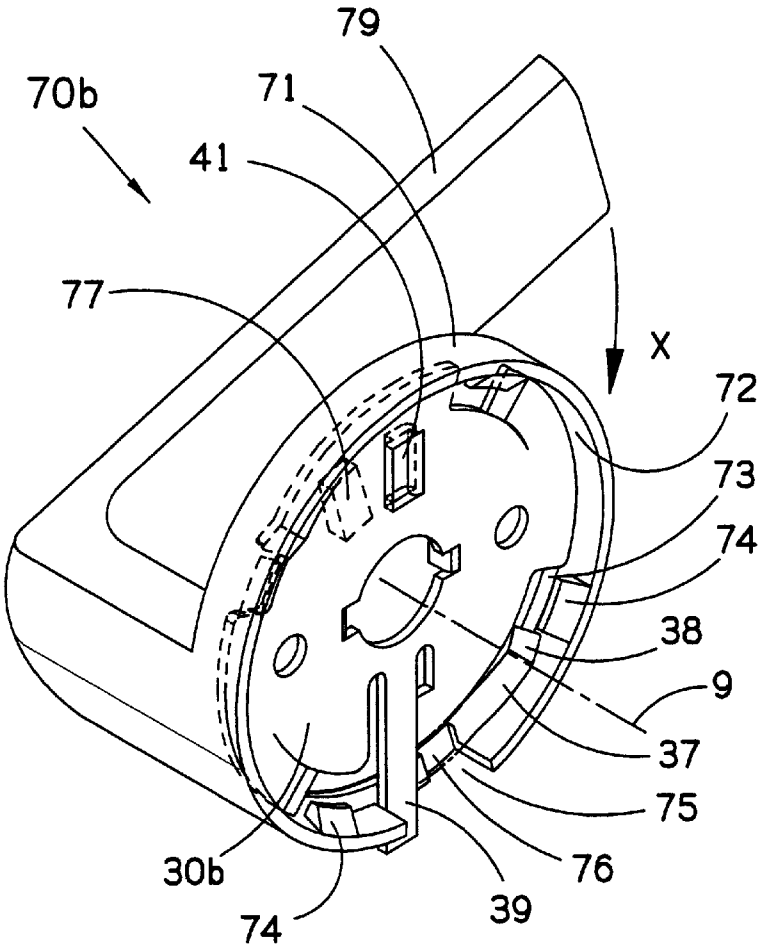

FIG. 6 shows the method of engagement of the coupling between the escutcheon 71 of handle unit 70 and the drive plate 30 of the latch drive assembly. The four notches 31 of the drive plate freely accommodate the four inwardly protruding undercut lugs 74 within the escutcheon. Rotation of the handle in the direction indicated by the arrow X engages the angled faces 38 of the crescent or tag members 37 with the underside faces of the undercut lugs 74. The ramp effect of the angled faces and the resilient nature of the material of the drive plate allows the crescent or tag members and the pawl 39 to deflect to conform with the fixed constraints of the undercut lugs and the reaction against the annular mounting face 73 of the escutcheon. It will be appreciated that the tag members 37 with notches 31 and undercut lugs 74, together form means for rotatably coupling the handle unit 70 to drive plate 30. Drive plate 30 may be considered to provide a platform to which the handle unit may be detachably fixed. Likewise, the escutcheon provides a platform for handle mounting thus liberating the designer from the normal constraint of the handle attachment at the axis of rotation.

Figure 7:
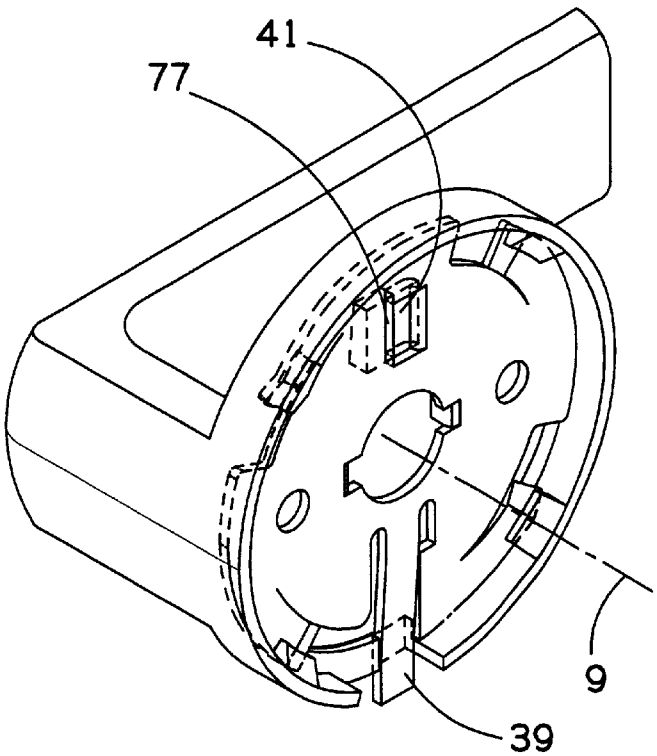
FIGS. 6 and 7 depict the engagement of the components of the handle unit coupling.

FIG. 7 shows the handle unit 70 fully engaged with the drive plate 30. In this relationship the pawl 39 engages the recess 76 simultaneously with the abutment of the complementary lug 77 of the escutcheon and projection 41 of the drive plate. The engagement the pawl 39 within the recess 76 prevents reverse rotation and consequent disengagement of the handle unit mounting. To remove the handle unit, the pawl 39 is deflected with a suitable tool to disengage it from the recess 76 to allow reverse rotation to disengage the coupling between the drive plate and the escutcheon.

It will be appreciated that, once the handle unit 70 is engaged and locked into the drive plate 30, and with the lever handle 79 in its normal return stop or "at rest" position, rotation of the handle 79 will be effective to rotate drive shaft 18 via drive member 40, and thereby to withdraw the latch bolt 17. Return of the handle unit 70 to the return stop position is assured by the coil spring 60 retained within the latch drive assemblies 2*a* and 2*b*.

Figure 8:
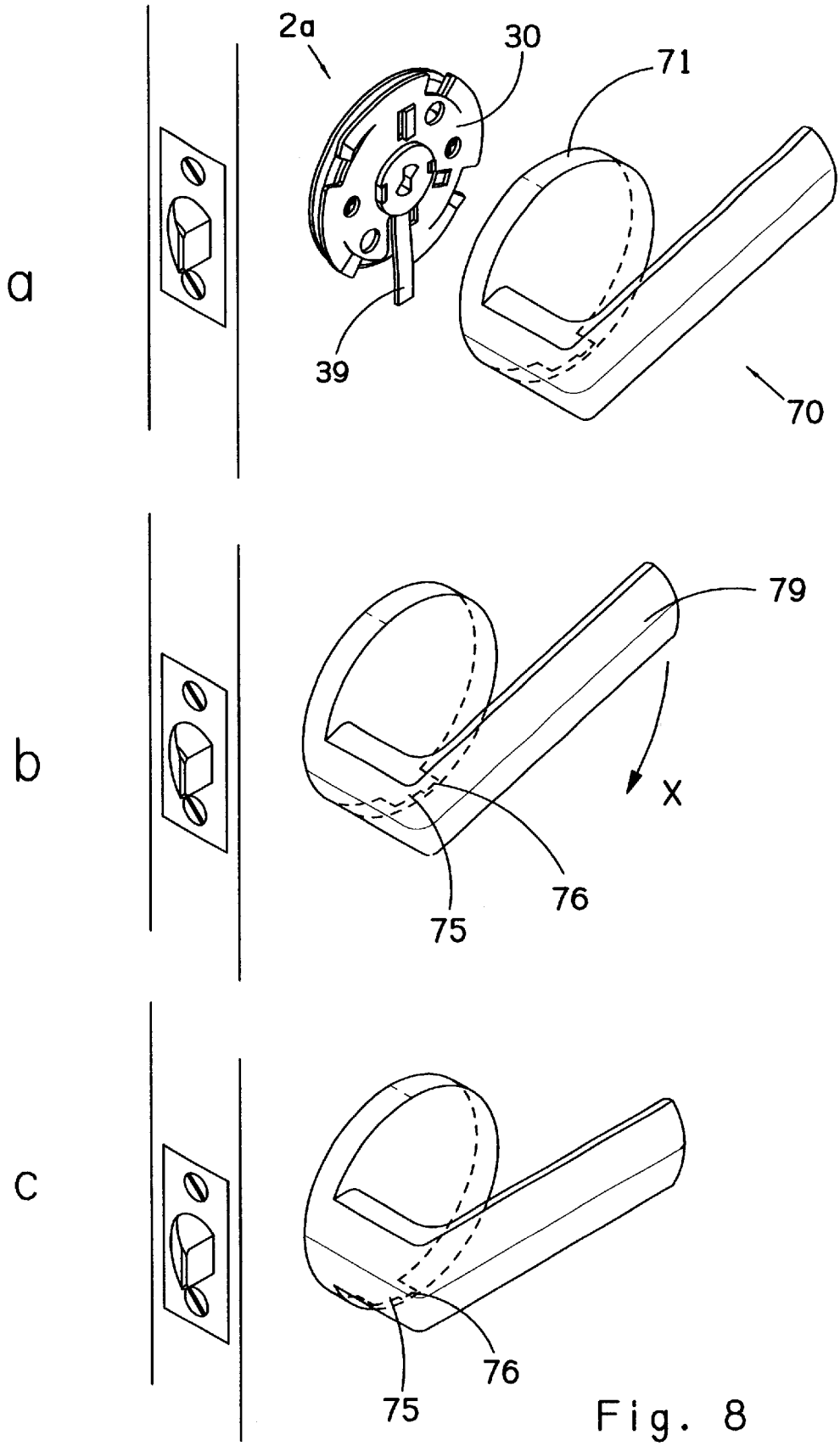
FIG. 8 depicts the latch set of FIGS. 1 to 7 installed in a door, and shows three successive steps (a, b, c) in mounting a handle unit to one of the latch drive assemblies.

FIG. 8 sequentially illustrates the mounting of a handle unit to a latch set installed within a door. FIG. 8*a* shows the latch set mounted in a door with the appropriately handed handle unit 70 at a particular rotational position to be presented for engagement with the drive plate 30. In FIG. 8*b* the handle unit is shown engaged with the drive plate, the pawl 39 being accommodated within the recess 76 of the escutcheon. The handle unit 70 is pressed firmly against the drive plate 30 and rotated in the direction of arrow X to engage the coupling. The rotation of the handle induces the drive plate to rotate and withdraw the bolt (this movement has been omitted from the illustration to simplify the description) but further rotation of the handle is required to fully engage the coupling. FIG. 8*c* shows the handle unit fully engaged with the latch drive assembly, The pawl 39 being engaged within the recess 76 to prevent removal of the handle unit by opposite rotation. Removal of the handle unit is effected by deflecting the pawl 39 with a suitable tool to disengage it from the recess 76, thus allowing contra-rotation and disengagement of the coupling.

FIG. 8*c* also well illustrates how, in the assembled condition of the latch drive set, the escutcheon 71 substantially envelopes and conceals the latch drive assembly 2*a*.

It will be apparent to those skilled in the door handle arts that the handle unit 70*b* (FIG. 5) is significantly different from conventional door handle levers. With conventional handle levers, the lever is supported at one end by a perpendicular stem which is rotationally engaged within an escutcheon, the lever being a cantilever which rotates about an axis concentric with the stem. Thus the manually graspable portion of the handle lever is extending sideways from the axis of rotation.

In the handle arrangement proposed in this invention, the design of the handle is not subordinated to the central axis. The handle can be fixed at any position on the face of the escutcheon and the escutcheon can be of any shape or size which will accommodate the internal mounting arrangements. Furthermore, the joining portion 78 which connects the lever handle lever 79 to the escutcheon 71 can be of any shape, style or dimension, even merging with the escutcheon. Likewise the handle lever can be of any shape and any angular disposition, these features providing greater scope for both handle and escutcheon design.

Privacy Locking Set

An optional privacy locking set for the door latch set of FIGS. 1 to 8 will now be described with reference to FIGS. 9 to 12. This privacy locking set may be readily applied to a variety of other latch sets. Accessories of this kind are considered to be an important option within any range of door handle sets, in order to provide a privacy locking function for a latch drive set installed in a bathroom, toilet or bedroom doors.

Ideally, a privacy locking set provides the facility for a door to be "snibbed" or locked from inside a room e.g. a bathroom, toilet or bedroom to prevent the entrance of other persons. It is also desirable to include an emergency release function, i.e. a safety override which allows release from the locked condition to be effected from the outside of the door by the use of a simple tool such as the tip of a pencil or similar pointed object. A third desirable feature is to include an automatic release function whereby the normal operation of the door handle on the inside of the room will disengage the lock mechanism without the need to first disengage the snib.

Figure 9:
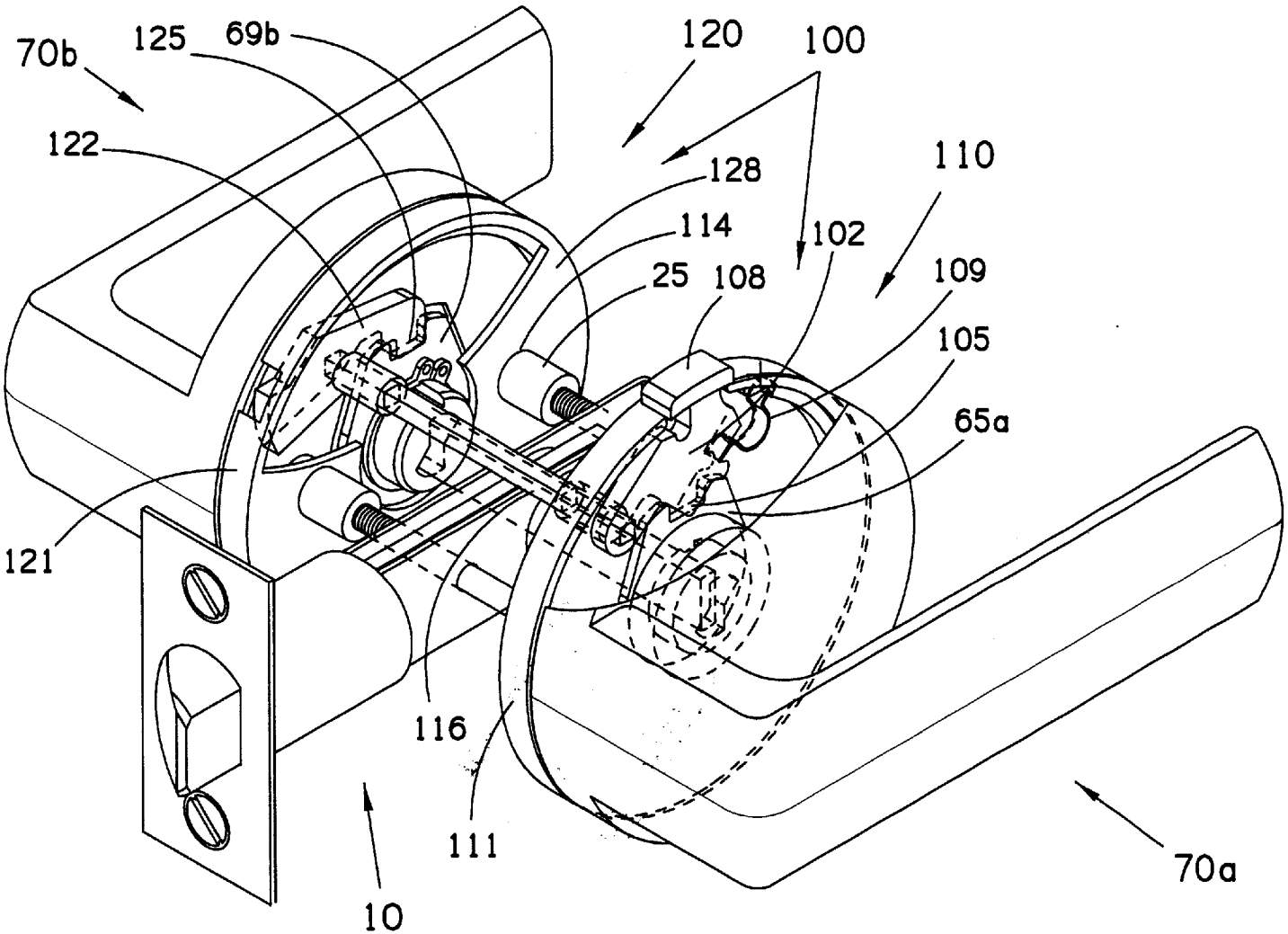
FIG. 9 depicts a full installation of a latch set and handle units with a privacy locking set in the locked position.
Figure 10:
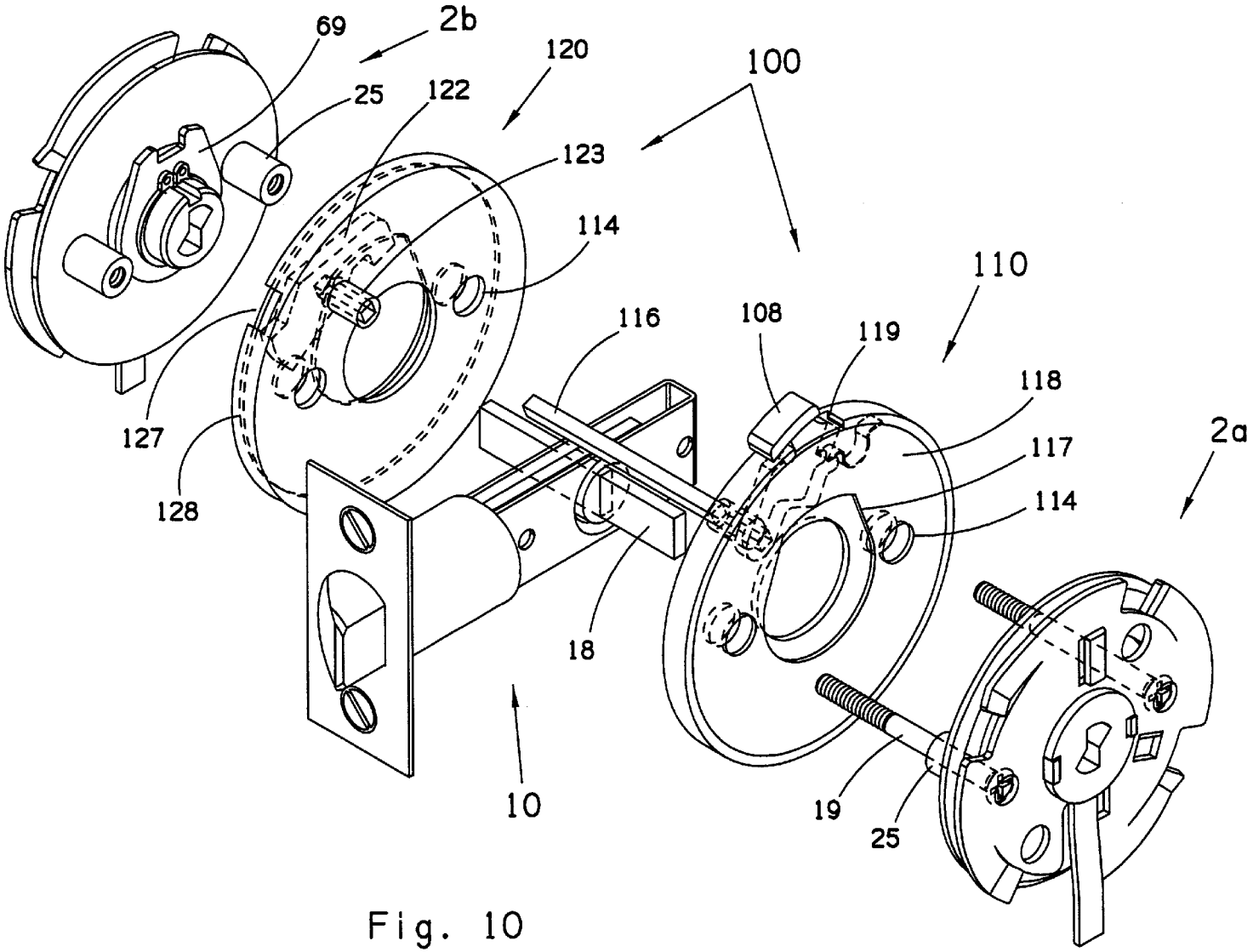
FIG. 10 is an exploded view of the components of the door latch set of FIG. 9 including the privacy locking set.
Figure 12:
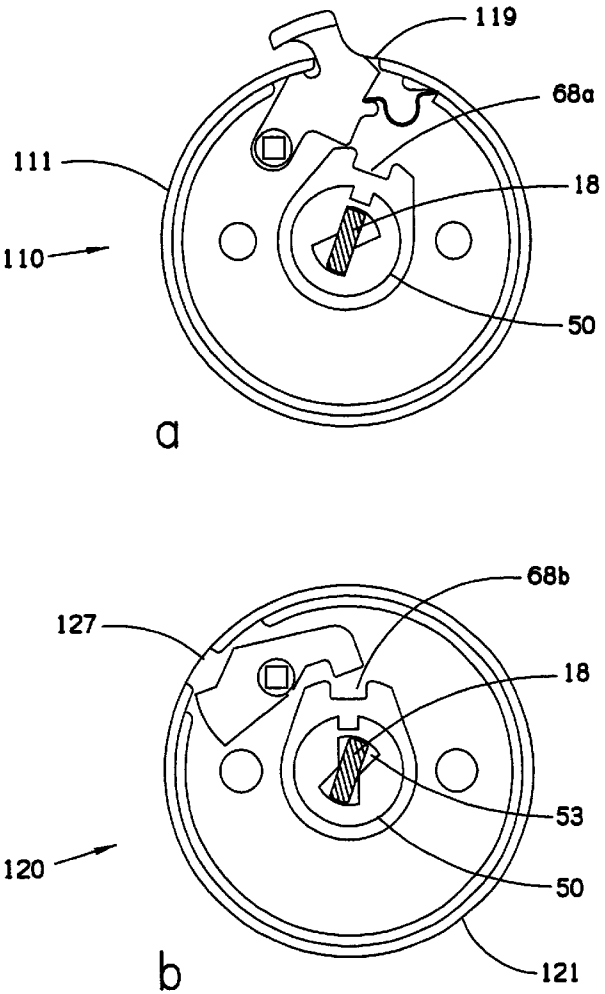
FIGS. 11 and 12 are schematic illustrations showing the function of the privacy locking set.

FIG. 9 shows a privacy locking set 100 as it would be installed with the latch drive set 1 complete with handles. The set includes a control unit 110 and a lock unit 120 on opposite sides of the door, operatively coupled by a link rod 116 which transmits rotation from a trigger 102 of the control unit to a locking arm 122 of the lock unit. Appropriate areas are illustrated cut away to show the inner mechanism of the privacy function. An exploded view which illustrates the relationship of the separate units as required for installation is depicted in FIG. 10. Control unit 110 is on the near side in these views, but the privacy set is ambidextrous and can equally well be installed with the units 110 and 120 on the opposite sides to that shown. This provides the option of installing the privacy set with the control unit 110 mounted on the appropriate side of the door.

Privacy control unit 110 is normally installed on the inside face of the door. This unit comprises four components, a circular peripherally flanged housing 111 and the trigger 102 (which would ideally be produced as metal die castings or plastic moldings), an omega shaped indexing spring 109 and a cover plate 118 (FIG. 10). Lock unit 120 is normally installed on the outside face of the door and comprises three components, a circular peripherally flanged housing 121, the locking arm 122 and a cover plate 128. Both housings 111, 121, of units 110, 120 respectively, and cover plates 118, 128 are provided with two holes 114 which engage on installation with the protruding fixing screw bosses 25 of the respective latch drive assemblies. The close fit of these items controls the concentric relationship between the individual units. Each unit 110, 120 of the privacy set is installed with the cover plate 118, 128 facing the back face of the respective latch drive assembly, a shaped central aperture 117 allowing entry into the housing of cam washer 69.

Figure 11:
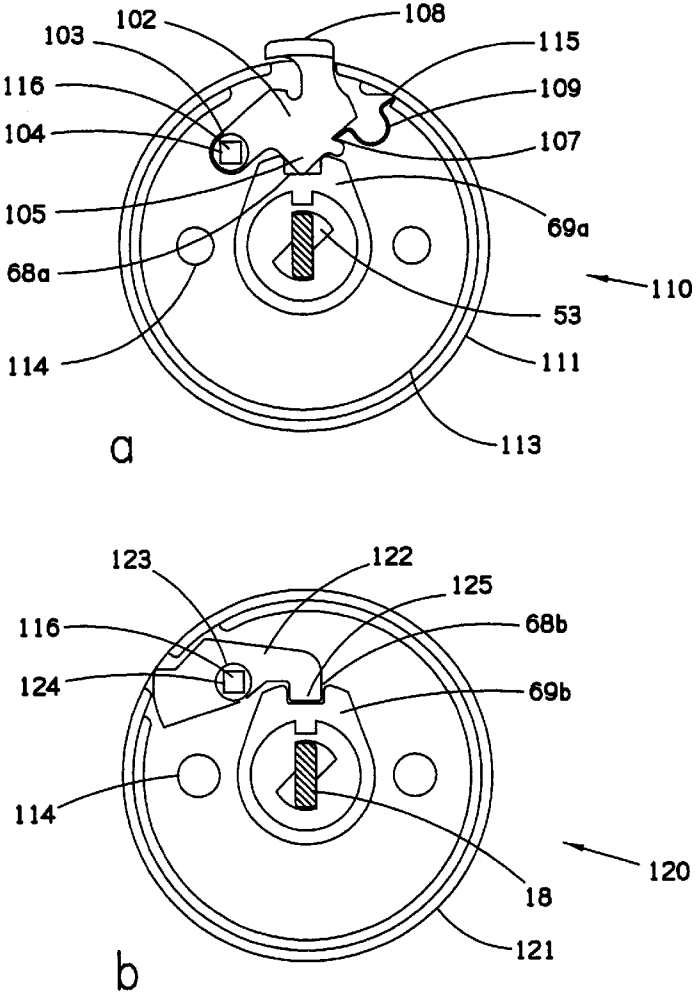

With reference in particular to FIG. 11, The trigger 102 pivots about a boss 103 which locates in a complementary hole provided in the back wall of housing 111. The boss 103 has a square or appropriately non circular passage 104 concentric with the boss axis for receiving link rod 116. The main profile of the trigger is designed to provide a head 108 which protrudes outside the housing via aperture 119 to provide access for actuation by depression with a finger tip. In the locked position the angled or V-shaped projection 105 intrudes within the rectangular notch 68*a* of the cam washer 69*a* at that side of the door. A "V" notch 107 accommodates one end of indexing spring 109, the other end being engaged within a similar "V" notch 115 in the inner rim 113 of the housing 111. The indexing spring is ideally made from spring steel of a rectangular cross section formed to the shape of the "omega" symbol. It is compressed lengthwise to engage with the two notches 107 and 115 and causes the trigger 102 to snap either side of a center line between the pivot point 103 and the V notch 115.

The locking arm 122 is similarly pivoted about boss 123 with a square passage 124 for link 116. The arm provides a rectangular dog 125 which, when the arm is set to the locking condition, engages notch 68*b* of cam washer 69*b* at the outside of the door, to lock the latch drive assembly at this side against rotation.

A safety override function is provided to unlock a door from the outside by the provision of an access aperture 127 in the outer rim of the housing 121. The locking arm 122, when in the locked position, can be engaged through the aperture 127 with a suitable tool and so pressed downwards to cause the arm to rotate and disengage dog 125 from the cam washer.

Square-section apertures 104, 124 are coupled by link rod 116 of matching cross-section. The engagement of these two elements with the common link rod ensures that the movement of the trigger 102 controls the positioning of the locking arm 122.

The two matching positions of the units are shown in FIGS. 11*a*, 11*b* and 12*a* and 12*b*. When the trigger 102 is set down (FIG. 11*a*), the locking dog 125 is engaged, rendering the door locked to entry from that side. Actuation of the handle on the inside latch drive assembly causes the cam washer 69*a* to rotate, bringing one corner of the rectangular notch 68*a* of the cam washer into contact with one edge of the V-shaped projection 105. Further rotation lifts this projection, causing the trigger 102 to rotate about its pivot boss 103 to a position where the indexing spring 109 passes beyond the centerline of its operation. At this point the spring drives the trigger to fully disengage from the cam washer and comes to rest with the stop face engaging the inner rim 113 of the housing 111. This movement of the trigger is transmitted via the link rod 116 to the locking arm 122 of the opposing side to disengage the dog 125 of the locking arm from the rectangular space 68*b* of the cam washer 69*b*, thus freeing the outside latch drive assembly for normal functioning.

The privacy locking set thereby has the desired automatic release function. It will be appreciated that the rotation of the inside handle to affect automatic release is possible because of the aforementioned independent rotational drives of the two handle units, the shape of shaft socket openings 53 permit the shaft to rotate in the normal direction at either boss 50 without rotating the respective handle unit.

It will be appreciated that, in its broadest aspects, the invention extends to handles and knobs other than lever handles. The illustrated embodiment eliminates the major constraints on door handle designs in that with these principals there is no need to design handles around a requirement to provide a socket to directly receive the shaft. All manner of molded, cast or fabricated shapes of handle can be applied to the more generous mounting facility proposed.

It will also be understood that the term "comprises" or its grammatical variants as used herein is equivalent to the term "includes" and not to be taken as excluding the presence of other elements or features.

What is claimed is:

1. A latch drive assembly comprising a pair of latch drive mechanisms each being mountable on opposite sides of a door and including means to engage with and rotationally actuate a door latch mechanism mounted within the door;

each latch drive mechanism comprising a mounting plate member being a substantially flat disc having means for mounting to an outer surface of a door and including concentric bearing means for rotationally locating a drive member;

the drive member comprising a substantially circular drive plate and including a cylindrical boss component projecting from the center of one face, the boss component being rotatably engaged within the central bore of the mounting plate member and the face of the drive plate overlying and in parallel contact with the outer face of the mounting plate, rotatable engagement being maintained by a washer and circlip engaged with a part of the boss extending beyond the inner rear face of the mounting plate;

the boss component of the drive member further includes a concentric passage shaped to engage with a drive shaft of rectangular section for rotational actuation of the latch unit;

the latch drive mechanism also includes spring means acting between the base plate member and the drive member for returning the drive member to a rotational stop position after actuation;

the latch drive assembly further includes a pair of handle units, each comprising a manually graspable lever element which is rigidly fixed to an escutcheon component and means within the escutcheon component for releasably fixing the handle unit to the drive plate member by engagement with complementary means provided at the periphery of the drive plate member, rotation of the handle unit when so attached actuating the latch unit via the drive shaft, the escutcheon component of the handle unit when so attached substantially enveloping and concealing the mounting plate and latch drive mechanism.

2. A latch drive assembly according to claim 1, wherein the handle unit comprises a manually graspable lever element transversely disposed and offset from the outside face of the escutcheon member and being rigidly fixed to the outer surface of the escutcheon member by a projection from one end of the lever;

the escutcheon member includes a circular recess on its reverse side which provides a close fit with the drive plate member of the corresponding latch drive mechanism, the recess further includes four radially inward projecting undercut lugs equispaced within the inner periphery of the recess, and the drive place having cutouts at its perimeter which freely accommodate the obstruction of the undercut lugs on engagement within the escutcheon, partial rotation of the handle when so engaged causing the outer diameter of the drive plate to engage behind the undercut lugs of the escutcheon, and the engagement of projections between the drive plate and the escutcheon provide a stop preventing further rotation between the drive plate and the handle unit;

the drive plate further includes resiliently deflectable tag members formed at a slight angle from the drive plate with ramped lead sections which engage the underside of the undercut lugs of the escutcheon to create a compressive force on engagement between the undercut lugs and the inner face of the escutcheon recess;

the drive plate further includes a radially projecting resiliently deflectable pawl which engages within a recess in the rim of the escutcheon for releasably fixing the handle unit against contra rotation and consequent disengagement, the tip of the pawl being accessible for deflection to disengage it from the recess for removal of the handle unit.

3. A latch drive mechanism according to claim 1, wherein the drive plate member includes a circular hole concentric with each of two fixing screw locations in the mounting plate when the drive plate is in the return stop position, the diameter of these holes is sufficient to allow access of an appropriate screwdriver but too small to allow passage for the screw head retained between the drive plate and its location in the countersunk hole of the mounting plate;

the drive plate further includes a circular hole concentric with each of the two fixing screw locations in the mounting plate when the drive plate is rotated to a position outside the range required for latch actuation, the diameter of these holes being sufficient to allow passage of the screw head to facilitate the insertion of the mounting screws.

4. A latch drive assembly according to claim 1, wherein the shaped passage within the boss section of the drive member is of a partially circular cross section which permits a limited degree of free rotation within the drive shaft engagement, the orientation of these passages in the two opposing latch drive units arranged to transmit rotational drive to a standard latch unit via a common drive shaft but allowing the opposing latch drive unit to remain stationary;

a keyway positioned axially at the outer diameter of the drive boss provides for irrotational engagement of the washer assembled to the rear of the mounting plate and retained by a circlip engaged with a part of the boss extending beyond the rear face of the mounting plate, the washer further includes an outer profile which performs a locking and disengaging cam function when installed with a privacy locking mechanism.

5. A latch drive assembly according to claim 4, wherein the latch drive assembly also includes a privacy locking function adapted for engagement between the latch drive units and the door surface on installation, the privacy locking unit includes, a control unit for mounting at the inner side of the door and having finger operable lock setting means, a lock unit for mounting at the outer side of the door selectively settable to a lock condition in which the handle at that outer side of the door is locked against rotation, means for linking the control unit to the lock unit whereby finger operation of the setting means at the inner side of the door is effective to set the lock condition at the outer side of the door, and means in the control unit whereby rotation of the handle at the inner side of the door releases the setting means and in turn, by virtue of the linking means, releases the lock condition at the outer side of the door during the independent rotation of the handle at the inner side of the door;

the privacy locking control unit comprises a circular housing in the form of a flat disc with means for concentric location against the back face of either latch drive unit, the housing has a central aperture and a recess to accommodate the drive boss and cam/locking washer projecting from the rear of the latch drive unit, the recess also accommodates the setting means which comprises a lever with a projecting boss which is pivotally located through a hole in the back of the housing positioned near the perimeter of the housing, the lever extends from one side of the boss to engage with the cam feature of the cam/lock washer of the latch drive unit, to the other side it extends outside the housing to facilitate finger operation of the setting means, the pivot allows oscillation between the lock engage and the release positions, actuation of the handle at the same side of the door causing the cam to move the lever from the engage to the disengage position, the independent operation of the handle at the setting side being facilitated by the shaped apertures of the two drive bosses engaging with the common latch drive shaft; an over center spring means is provided lo ensure positive hand engagement and cam disengagement of the setting means;

the setting means further includes a square aperture concentric with the projecting boss of the lever which provides for the engagement with a square shaft for the transmission of rotational actuation from the control unit on one side of the door to the lock unit on the opposite side of the door, the shaft passing through a 54 mm diameter hole provided in a door;

the lock unit comprises a similar housing arrangement to the control unit with a similar pivotally mounted lever concentrically aligned with the setting means also engaging with the square shaft which transmits rotational actuation from the control unit, the lever has a hooked projection at its distal end for engagement within a rectangular notch provided at the periphery of the cam/lock washer which, when engaged, locks the handle at that side of the door against rotation, an aperture is provided at the outer rim of the housing to access the locking lever to facilitate an emergency disengage function.

* * * * *